US010006289B2

(12) United States Patent
Kim et al.

(10) Patent No.: US 10,006,289 B2
(45) Date of Patent: Jun. 26, 2018

(54) REACTIVE TURBINE APPARATUS

(71) Applicant: HK TURBINE CO., LTD., Anyang-si (KR)

(72) Inventors: Ki-Tae Kim, Anyang-si (KR); Young Il Chang, Seoul (KR); Jung-Hoon Kim, Yongin-si (KR)

(73) Assignee: HK TURBINE CO., LTD., Anyang-si (KR)

( * ) Notice: Subject to any disclaimer, the term of this patent is extended or adjusted under 35 U.S.C. 154(b) by 727 days.

(21) Appl. No.: 14/348,153

(22) PCT Filed: Sep. 24, 2012

(86) PCT No.: PCT/KR2012/007665
§ 371 (c)(1),
(2) Date: Mar. 28, 2014

(87) PCT Pub. No.: WO2013/048072
PCT Pub. Date: Apr. 4, 2013

(65) Prior Publication Data

US 2014/0248124 A1 Sep. 4, 2014

(30) Foreign Application Priority Data

Sep. 30, 2011 (KR) ..... 10-2011-0100089

(51) Int. Cl.
*F01D 1/32* (2006.01)

(52) U.S. Cl.
CPC ..... *F01D 1/32* (2013.01)

(58) Field of Classification Search
CPC ..... F01D 1/32
(Continued)

(56) References Cited

U.S. PATENT DOCUMENTS 1,681,607 A * 8/1928 Bowen ..... F01D 1/026 415/80
2,945,670 A 7/1960 Caddell
(Continued)

FOREIGN PATENT DOCUMENTS

CH 161928 A * 5/1933 ..... F01D 1/32
DE 446413 C * 6/1927 ..... F01D 1/32
(Continued)

OTHER PUBLICATIONS

German Office Action dated Sep. 28, 2015, in counterpart German Application No. DE 112012004080.5 (16 pages, with English Translation).
(Continued)

*Primary Examiner* — Jason T Newton
(74) *Attorney, Agent, or Firm* — NSIP Law

(57) ABSTRACT

The present invention relates to a reactive turbine apparatus that is easy to assemble. To this end, the reactive turbine apparatus includes: a rotation shaft formed of a certain length; a housing defining an inner space so as to be rotatably coupled to the rotation shaft, having an inlet formed through one side thereof through which working fluid can enter, and having an outlet formed through the other side thereof so that working fluid can be discharged to the outside; and at least one rotation unit disposed in the housing and coupled to the rotation shaft, disposed in a lengthwise direction of the rotation shaft, and rotating the rotation shaft by means of the working fluid that enters from the inlet of the housing and is discharged, wherein working fluid is prevented from leaking between the peripheral surface of the at least one rotation unit and the inner surface of the housing during the rotation of the rotation unit.

10 Claims, 10 Drawing Sheets

(58) Field of Classification Search
USPC ..... 417/77
See application file for complete search history.

(56) References Cited

U.S. PATENT DOCUMENTS

| | | | | | |
|---|---|---|---|---|---|
| 3,032,988 | A * | 5/1962 | Kleckner | F01D 1/32 | 415/80 |
| 4,178,125 | A * | 12/1979 | Dauvergne | F01D 1/32 | 415/80 |
| 2012/0009055 | A1* | 1/2012 | Kim | F01D 1/22 | 415/80 |

FOREIGN PATENT DOCUMENTS

| | | | | |
|---|---|---|---|---|
| DE | 1109452 | B * | 6/1961 | F02B 53/00 |
| DE | 2607600 | A1 * | 9/1977 | F01D 1/32 |
| DE | 2739055 | A1 * | 3/1979 | F01D 1/32 |
| DE | 3008973 | A1 | 9/1981 | |
| EP | 0035757 | A1 * | 9/1981 | F01D 1/32 |
| FR | 345573 | A * | 12/1904 | F01D 1/32 |
| JP | 2000-213301 | | 8/2000 | |
| JP | 2004-132208 | | 4/2004 | |
| KR | 10-2009-0076158 | | 7/2009 | |
| KR | 10-1052253 | | 7/2011 | |
| WO | WO 96-12872 | | 5/1996 | |
| WO | WO 2010107146 | A1 * | 9/2010 | F01D 1/22 |

OTHER PUBLICATIONS

International Search Report dated Feb. 7, 2013 in corresponding International Patent Application No. PCT/KR2012/007665 (5 pages, in English and Korean).

* cited by examiner

REACTIVE TURBINE APPARATUS

CROSS-REFERENCE TO RELATED APPLICATIONS

This application is a U.S. National Stage Application of International Application No. PCT/KR2012/007665, filed on Sep. 24, 2012, which claims the benefit under 35 USC 119(a) and 365(b) of Korean Patent Application No. 10-2011-0100089, filed on Sep. 30, 2011, in the Korean Intellectual Property Office.

TECHNICAL FIELD

The present invention relates to a reactive turbine apparatus, and more particularly, to a reactive turbine apparatus that generates rotation torque using steam, gas, or compressed air.

BACKGROUND ART

A steam turbine is a motorized device used to convert thermal energy from pressurized steam into mechanical motion. Due to low vibration, great efficiency, and high-speed and large-horsepower, the steam turbine has been widely used as a main engine for thermal power plants and ships.

Korean Patent Registration No. 10-1052253 (published on Apr. 15, 2009) discloses a reactive turbine. Unlike a general turbine, in the reactive turbine, a working fluid is sprayed out from rotors, and a resultant repulsive force causes the rotors to rotate.

As shown in FIG. 1 of Korean Patent Registration No. 10-1052253, a plurality of ejecting rotor units 120A, 120*b*, and 120C sequentially arranged around the turbine shaft 130, and as shown in FIG. 17, in a state in which rotors 240, 250, and 260 have been welded to the turbine shaft 280, it is impossible to couple housings 210, 220, and 230 to the turbine shaft 280, so that it is required for the housings are separately manufactured and then, the assembly is performed by alternately inserting the rotors and the housings one by one. Thus, the assembly is not easy, which may hinder the alignment among the shaft axes of all parts of the turbine.

Technical Problem

The purpose of the present invention is to provide a reactive turbine apparatus that is easy to assemble.

The purpose of the present invention is to provide a reactive turbine apparatus with an improved structure to prevent a great amount of pressure from being exerted on a thrust bearing.

Technical Solution

The present invention provides a reactive turbine apparatus including: a rotation shaft formed of a predetermined length; a housing defining an inner space so as to be rotatably coupled to the rotation shaft, having an inlet formed on one end thereof through which a working fluid can enter, and having an outlet formed on the other end thereof through which the working fluid can be discharged to an outside; and at least one rotation unit being disposed inside the housing and coupled to the rotation shaft, being disposed in a lengthwise direction of the rotation shaft, and rotating the rotation shaft by means of the working fluid that enters from the inlet of the housing and then is ejected, wherein the working fluid is prevented from leaking between a peripheral surface of the at least one rotation unit and an inner surface of the housing during rotation of the rotation unit.

Advantageous Effects

According to the present invention, the manufacturing of a reactive turbine apparatus can be completed by firstly coupling a housing to a rotation shaft and then coupling only a rotation unit inside the housing, or by coupling the housing to the rotation shaft after coupling only the rotation unit to the rotation shaft, and thus the relative turbine apparatus can be more easily assembled, compared to the conventional reactive turbine apparatus.

In addition, since the reactive turbine apparatus of the present invention has a structure easy to assemble, it is easy to align the centers of the housing and the rotation unit, and thus vibration generated during the operation and the leakage loss can be reduced.

MODE FOR INVENTION

Figure 1:
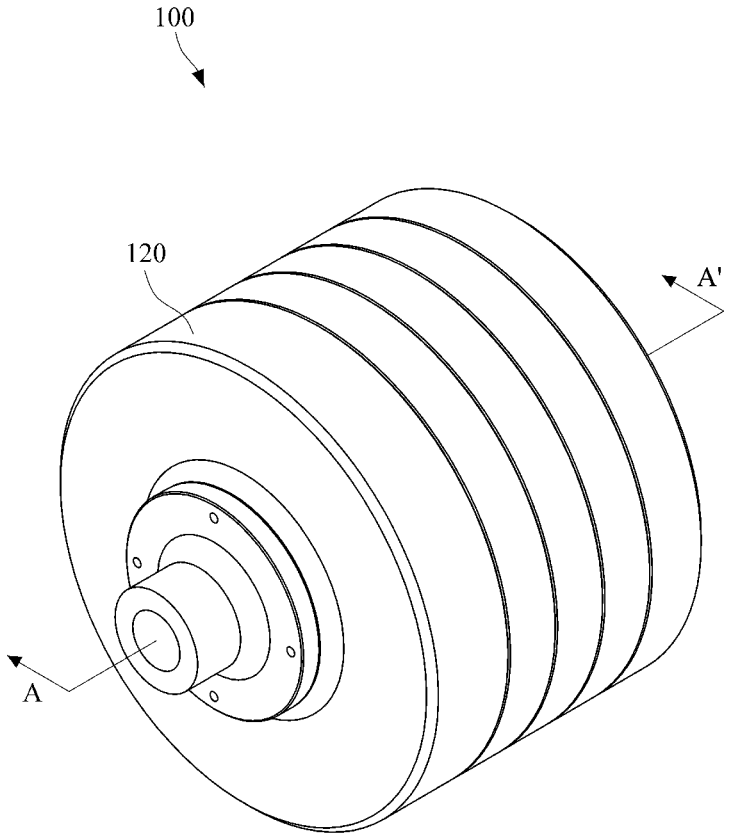
FIG. 1 is a perspective view of a reactive turbine apparatus according to an exemplary embodiment of the present invention.

The invention is described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawing figures, the relative size and depiction of elements may be exaggerated for clarity of illustration.

Figure 2:
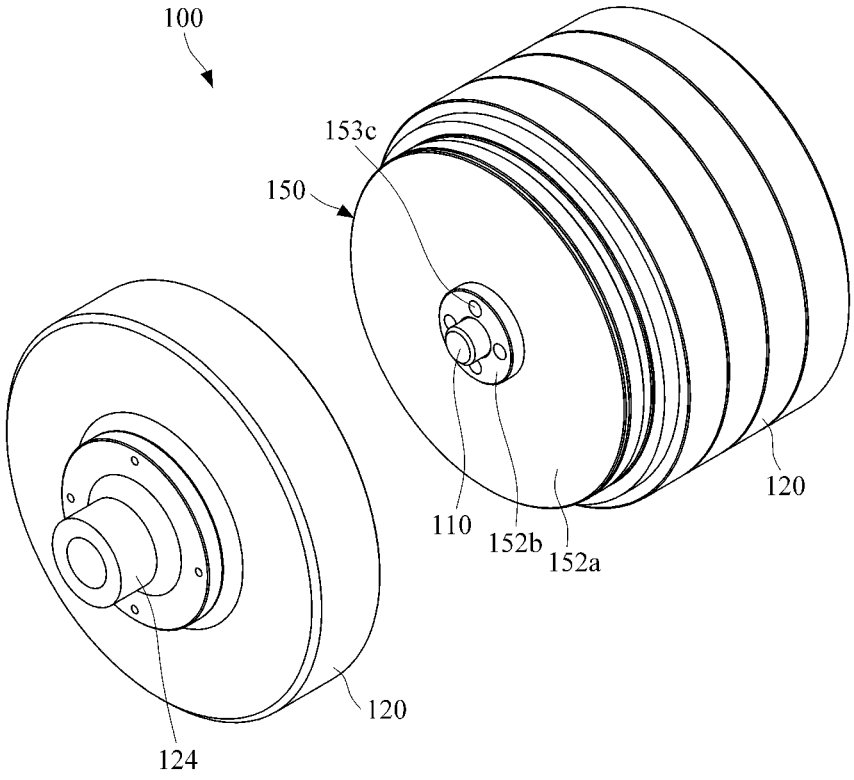
FIG. 2 is an exploded perspective view of a housing of the reactive turbine apparatus of FIG. 1.
Figure 3:
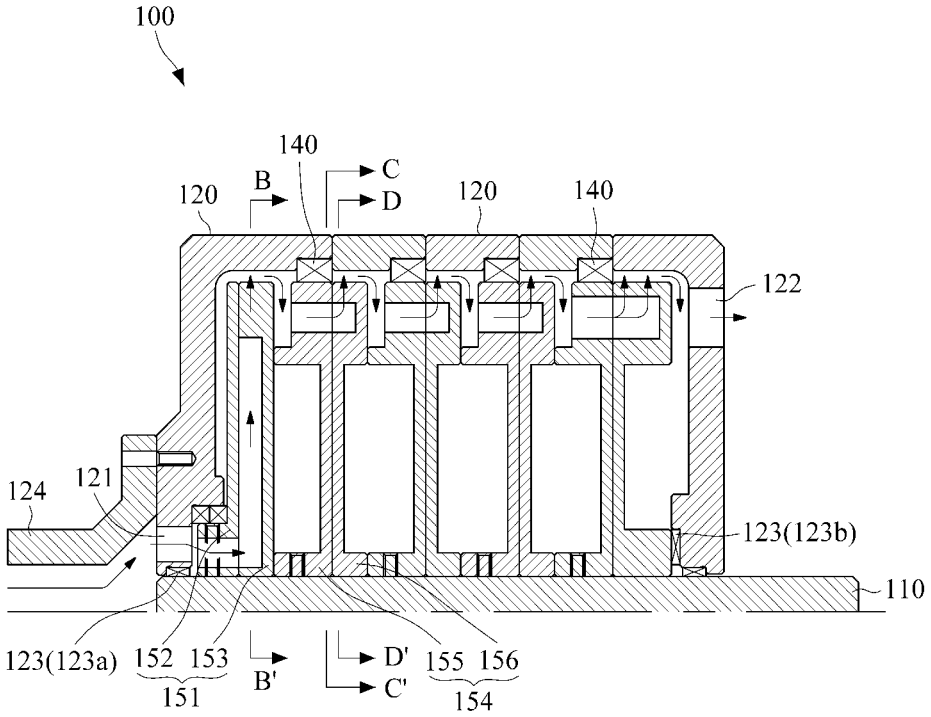
FIG. 3 is a cross-sectional view of the reactive turbine apparatus taken along line A-A' of FIG. 1.

Referring to FIGS. 1 to 3, a reactive turbine apparatus 100 includes a rotation shaft 110, a housing 120, and a rotation unit 150 according to an exemplary embodiment of the present invention.

The rotation shaft 110 has a predetermined length. When the reactive turbine apparatus 100 is applied to a generator, the rotation shaft 110 may be connected with an electromagnet included in the generator to produce electricity. In addition, when the reactive turbine apparatus 100 is applied to a power system, the rotation shaft 110 may have a belt or a gear coupled thereto.

The housing 120 defines an inner space. The housing 120 is rotatably coupled to the rotation shaft 110. The housing 120 may be fixed onto the ground. In this case, the rotation shaft 110 and a rotation unit 150, which will be described later, rotate together with each other. A bearing 120 may be installed at an area where the housing 120 and the rotation shaft 110 touch each other. The housing 120 may have a cylindrical shape. The housing 120 has an inlet 121 penetrating one end thereof to allow a working fluid to flow in the housing 120. The inlet 121 may include one hole or a plurality of holes.

The housing 120 may further include a cover 124. The cover 124 is formed to be close to the inlet 121 of the housing 120. The cover 124 is formed to guide the working fluid supplied from an external source to enter the inlet 121. The housing 120 has an outlet 120 penetrating the other end thereof to allow the working fluid to be discharged to the outside. For example, if the housing 120 has the inlet 121 in the left end, the outlet 122 may be formed on the right side of the housing 120. Alternatively, if the housing 120 has the outlet 122 in the left side, the inlet 121 may be formed on the right side of the housing 120. The outlet 122 may include a single hole or a plurality of holes.

The housing 120 may be divided into a number of sections along the lengthwise direction of the rotation shaft 110. For example, in the case of the housing 120 with a cylindrical shape, the portion of the housing 120, other than the areas where the inlet 121 and the outlet 122 are respectively formed, may be divided by a predetermined length along the lengthwise direction of the rotation shaft 110.

The rotation unit 150 may be disposed within the housing 120 in the lengthwise direction of the rotation shaft 110 and coupled to the rotation shaft 110. The rotation unit 150 rotates the rotation shaft 110 as the working fluid introduced through the inlet 121 is ejected. That is, the rotation unit 150 produces rotation torque.

In one aspect, the reactive turbine apparatus 100 may be configured to prevent a working fluid to leak between a peripheral surface of the rotation unit 150 and an inner surface of the housing 120 during the rotation of the rotation unit 150.

The reactive turbine apparatus 100 with the structure as described above can be easily assembled, compared to the conventional reactive turbine apparatus, since only the rotation unit 150 is coupled inside the housing 120 after the housing 120 is coupled to the rotation shaft 110, or the housing 120 is coupled to the rotation shaft 110 after only the rotation unit 150 is coupled to the rotation shaft 110.

In addition, with the structure easy to assemble, the reactive turbine apparatus 100 is also easy to align the centers of the housing 120 and the rotation unit 150, thereby reducing vibration generated during the operation and also leakage loss.

Referring to FIG. 3, the inlet 121 of the reactive turbine apparatus 100 may be formed to be close to the rotation shaft 110.

One example of the rotation unit 150 of the reactive turbine apparatus 100 may include a first rotation part 151 and a second rotation part 154.

The first rotation part 151 has a disc shape. The first rotation part 151 may have first penetrating parts 153*c* to allow the working fluid to flow therein in a direction parallel to the rotation shaft 110. The first rotation part 151 may allow the working fluid, which has entered through the inlet 121, to pass through the inside thereof and then be discharged to a peripheral surface thereof. The first rotation part 151 may include a first body part 152 and a second body part 153. Referring back to FIG. 2, the first body part 152 may include a base part 152*a* and a protruding part 152*b*. The base part 152*a* may have a disc shape. The base part 152*a* may have a hollow hole to allow the rotation shaft 110 to pass therethrough.

The protruding part 152*b* is formed to enclose the rotation shaft 110 while protruding from one surface of the base part 152*a* by a predetermined length. The first penetrating parts 153*c* may be formed to penetrate the protruding part 152*b*. The first penetrating parts 153*c* may have an arc shape, and be disposed at a predetermined angle with respect to the rotation shaft 110. The working fluid that has flowed in through the inlet 121 of the housing 120 moves through the first penetrating parts 153*c*.

Figure 4:
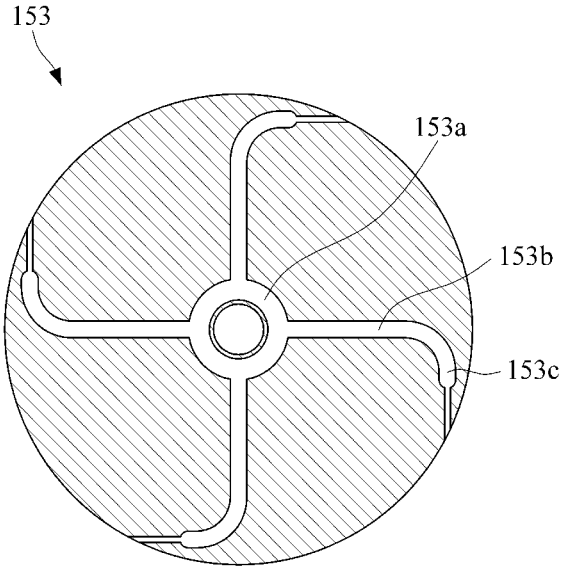
FIG. 4 is a cross-sectional view of a second body part of a first rotation part of the reactive turbine apparatus taken along line B-B' of FIG. 3.

As shown in FIG. 4, the second body part 153 may have a disc shape corresponding to the shape of the base part 152*a* of the first body part 152. The second body part 153 may include an inlet groove 153*a*, conveying grooves 153*b*, and nozzles 153*c*. The inlet groove 153*a* is located at a position corresponding to the hole of the protruding part 152*b* of the first body part 152 while the first body part 152 is in contact with the second body part 153. The inlet groove 153*a* may be a circular groove recessed by a given depth. The conveying groove 153*b* may communicate with the inlet groove 153*a* and may be formed into a straight line in a direction perpendicular to a tangential line of a circumference of the second body part 153, having an end extending close to the circumference of the second body part 153. The nozzles 153*c* may be formed at a predetermined angle with respect to the respective conveying grooves 153*b*.

The second body part 153 with the above structure may allow the working fluid to be ejected through the nozzles 153*c* at an angle that is closest to the tangential direction of the second body part 153 of a disc shape. For the working fluid to be ejected in a direction as close as possible to the tangential direction of the second body part 153, the rotation torque of the second body part 153 may be set close to the maximum. There may be four nozzles 153*c*, but the aspects of the embodiment are not limited thereto.

The second rotation part 154 has a disc shape with one surface closely attached to one surface of the first rotation part 151. The second rotation part 154 includes a passage, which is not illustrated. The passage is disposed at a location corresponding to the first penetrating part 153*c* of the first rotation part 151, at a predetermined depth. Also, the second rotation part 154 includes a plurality of nozzles that communicate with the passage to eject the working fluid to the peripheral surface thereof.

Referring back to FIG. 3, there may be provided a single or multiple second rotation part(s) 154. In a case of multiple second rotation parts 154, the second rotation parts 154 may be arranged to closely adhere to each other along a lengthwise direction of the rotation shaft 110. More specifically, the second rotation part 154 may include a third body part 155 and a fourth body part 156.

Figure 5:
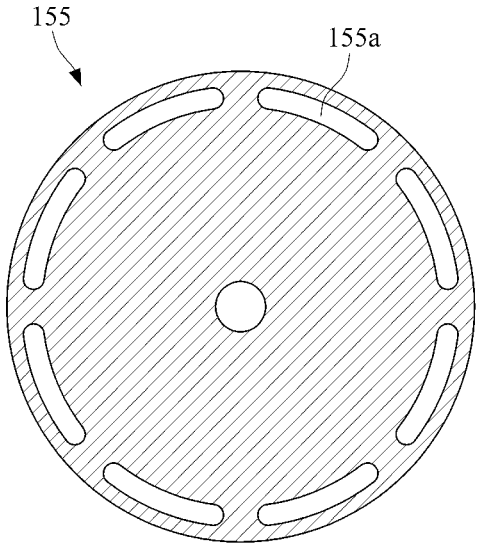
FIG. 5 is a cross-sectional view of a third body part of a second rotation part of the reactive turbine apparatus taken along line C-C' of FIG. 3.

Referring to FIG. 5, the third body part 155 has a disc shape. The third body part 155 may include second penetrating parts 155*a*. The second penetrating parts 155*a* may have an arc shape, penetrating the third body part 155 in a direction parallel to the rotation shaft 110, thereby allowing the working fluid, which has been discharged through the first rotation part 151, to flow therein. There may be a plurality of second penetrating parts 155 which may be concentric to the rotation shaft 110. The second penetrating parts 155*a* may be arranged at a predetermined distance with respect to the rotation shaft 110.

Figure 6:
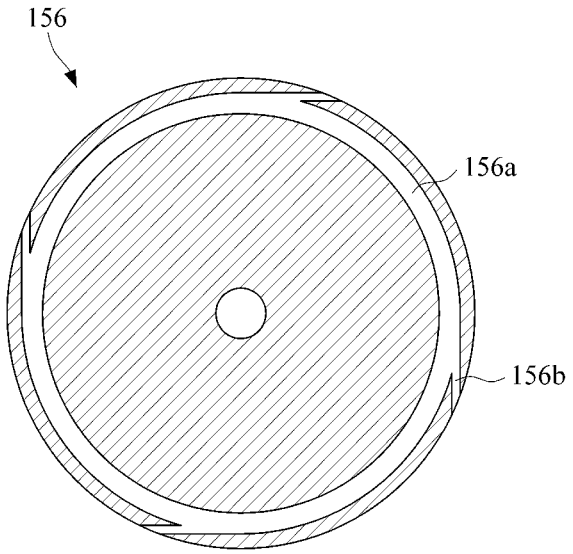
FIG. 6 is a cross-sectional view of a fourth body part of the second rotation part of the reactive turbine apparatus taken along line D-D' of FIG. 3.

Referring to FIG. 6, the fourth body part 156 may have a disc shape. The fourth body part 156 is disposed to have one surface closely attached to one surface of the third body part 155. The fourth body part 156 may have a passage 156*a* with a closed circular shape recessed at a predetermined depth at a location corresponding to the second penetrating parts 155*a* of the third body part 155. In addition, the fourth body part 156 may include a plurality of nozzles 156*b* that communicate with the passage 156*a* to eject the working fluid toward the circumferential surface of the fourth body part 156.

Referring back to FIG. 3, a bearing 123*b* may be disposed between an inner surface of a portion of the housing 120 where the outlet 122 is formed and the second rotation part 154 located to touch the portion of the housing 120 where the outlet 122 is formed. The bearing 123 may facilitate the rotation of the rotation unit 150 inside the housing 120. The bearing 123*b* may be, for example, a thrust bearing.

The reactive turbine apparatus 100 may further include a sealing member 140. The sealing member 140 may be interposed between the peripheral surface of the rotation unit 150 and the inner surface of the housing 120. The sealing member 140 may be labyrinth seal. The labyrinth seal is made of a self-lubricating material. The labyrinth seal allows the working fluid to pass through the first rotation part 151 and to flow only into the second rotation part 154 adjacent to the first rotation part 151, and prevents the working fluid from entering into the second rotation part 154 far from the first rotation part 151. In the case where the rotation unit 150 includes a plurality of second rotation units 154, the labyrinth seal allows the introduction and discharge to sequentially occur in the second rotation parts 154 along a lengthwise direction of the rotation shaft 110. Also, the labyrinth seal prevents the working fluid of high pressure from leaking out of the housing 120.

Figure 7:
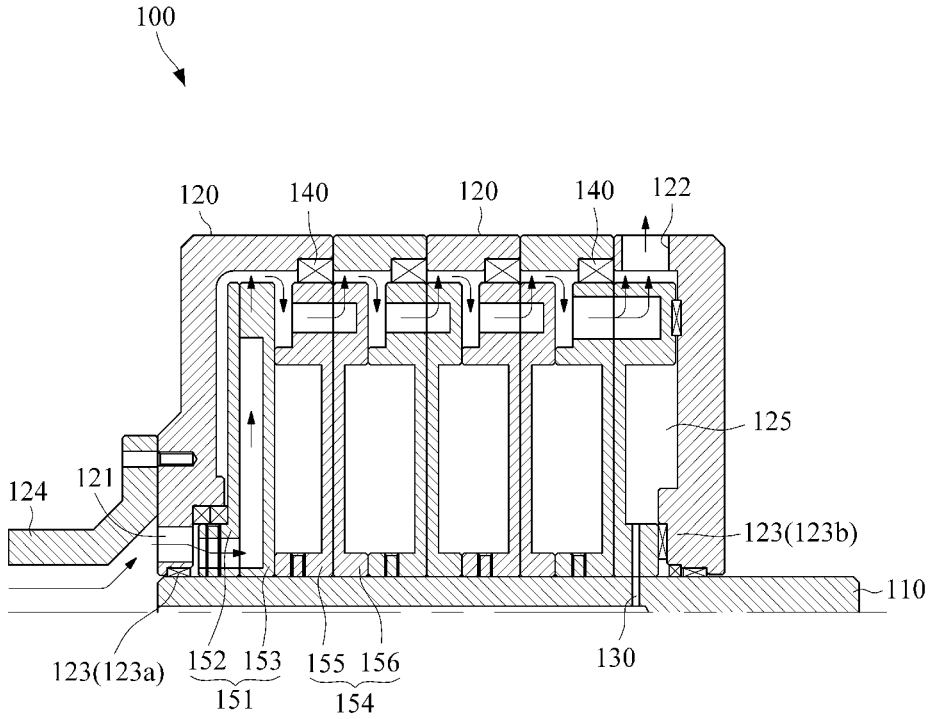
FIG. 7 is a cross-sectional view of a modification example of a rotation unit and a rotation shaft of the reactive turbine apparatus of FIG. 1.

Referring to FIG. 7, the reactive turbine apparatus 100 may further include a back pressure chamber 125 and a communication path 130.

The back pressure chamber 125 is interposed between the housing 120 and the rotation unit 150 that is the closest to the outlet 122.

The communication path 130 allows communication between the inside and outside of the back-pressure chamber 125. More specifically, the communication path 130 is formed to extend from one end of the rotation shaft 110 and pass through the inside to communicate with the back-pressure chamber 125. The working fluid is provided to the back-pressure chamber 125 through the communication path 130.

Pressure is likely to be applied to the first rotation part 151 and the second rotation part 154 while the working fluid introduced through the inlet 121 of the housing 120 passes through the rotating unit 150. More specifically, the first rotation part 151 and the second rotation part 154 may be applied pressure in a first direction which is the right direction in the drawing. Accordingly, a substantially great amount of pressure is likely to be applied to the inner surface of the housing 120 where the outlet 122 is formed and to the thrust bearing 123 disposed between the inner surface of the portion of the housing 120 where the outlet 122 is formed and the second rotation part 154 located to touch the portion of the housing 120 where the outlet 122 is formed.

However, the communication path 130 allows the same working fluid as the working fluid entering through the inlet 121 of the housing 120 to be provided to the back-pressure chamber 125, thereby applying pressure to the rotation unit 150 in a second direction that is opposite to the first direction. As a result, the pressure exerted on the thrust bearing 123 is mostly cancelled out, and thus it is possible to prevent the thrust bearing 123 from being damaged.

Figure 8:
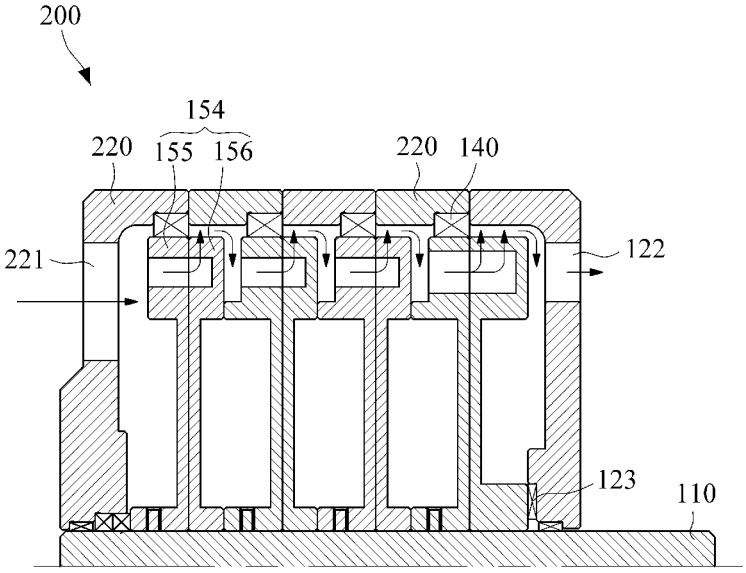
FIG. 8 is a cross-sectional view of a reactive turbine apparatus according to another exemplary embodiment of the present invention.

Referring to FIG. 8, a reactive turbine apparatus 200 in accordance with another exemplary embodiment of the invention may include the inlet 221 formed on a portion close to a circumferential surface of the housing 220. Unlike the reactive turbine apparatus 200, the rotation unit 150 of the reactive turbine apparatus 200 with such a structure may not include the first rotation part 151 (refer to FIG. 3), but may include only the second rotation part 154. Since the structure of the second rotation unit 154 is the same as the second rotation part 154 of the reactive turbine apparatus 100 (refer to FIG. 3), the detailed description thereof will be omitted.

In the reactive turbine apparatus 200 in accordance with another exemplary embodiment, the inlet 221 may be formed at a location facing the second penetrating part 155*a* of the third body part 155 of the second rotation part 154. The working fluid introduced through the inlet 221 is allowed to directly enter into the second penetrating part 155*a* of the third body part 155 of the second rotation part 154.

Figure 9:
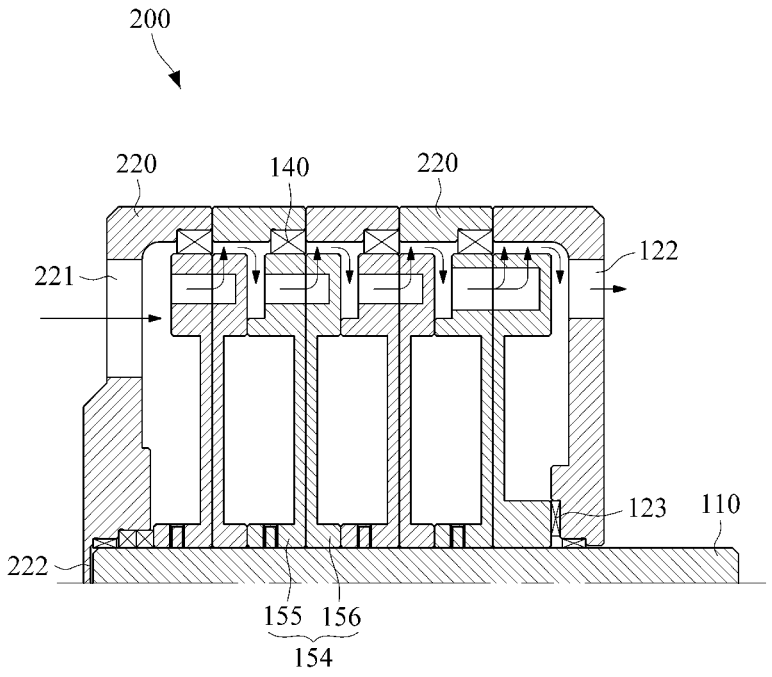
FIG. 9 is a cross-sectional view of a modification example of the reactive turbine apparatus of FIG. 8.

Referring to FIG. 9, the housing 220 may further include a sealing part 222. The sealing part 222 is formed to enclose one side of the rotation shaft 110 where the inlet is formed. The sealing part 222 may minimize impurities entering a space between a free end of the rotation shaft 110 and the housing 220.

Figure 10:
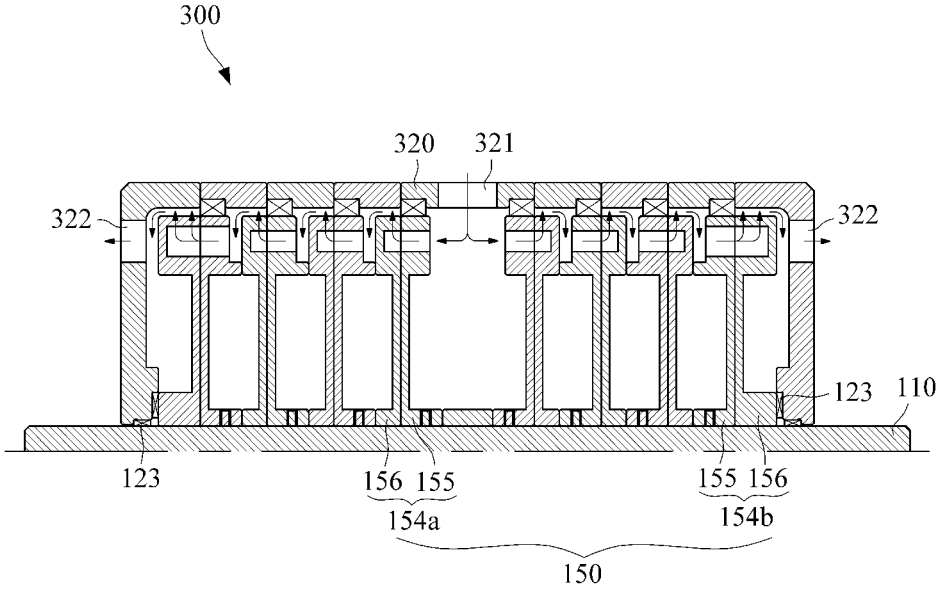
FIG. 10 is a cross-sectional view of a reactive turbine apparatus according to yet another exemplary embodiment of the present invention.

Referring to FIG. 10, a reactive turbine apparatus 300 in accordance with yet another exemplary embodiment of the present invention includes a rotation shaft 110, a housing 320, and a rotation unit 150. Since the rotation shaft 110 and the rotation unit 150 of the reactive turbine apparatus 300 are the same as the aforementioned reactive turbine apparatus 300, the detailed description thereof will not be reiterated.

The inlet 321 of the reactive turbine apparatus 300 as described above is formed on one end of the housing 320 and the outlet 122 is formed on the other end. However, in the reactive turbine apparatus 300 according to another exemplary embodiment of the present invention, the inlet 321 is formed in the middle portion of the circumferential surface of the housing 320, the rotation unit 150 is symmetrically disposed with respect to the inlet 321, and the outlet 122 is formed on each end of the housing 320. In addition, similarly to the reactive turbine apparatus 100 (refer to FIG. 3), the reactive turbine apparatus 300 according to the exemplary embodiment may be configured to prevent a working fluid from leaking between the peripheral surface of the rotation unit 150 and the inner surface of the housing 320 during the rotation of the rotation unit 150.

In the reactive turbine apparatus 300 with the above structure, the rotation unit 150 may include a plurality of second rotation parts 154*a* (hereinafter, will be referred to as "left second rotation parts") at the left side with respect to the inlet 321. Also, the rotation unit 150 may include a plurality of second rotation parts 154*b* (hereinafter, will be referred to as "right second rotation parts") at the right side with reference to the inlet 321. The left second rotation parts 154*a* and the right second rotation parts 154*b* may be coupled to the rotation shaft 110 to rotate in the same direction by virtue of the working fluid.

While this invention has been particularly shown and described with reference to preferred embodiments thereof, it will be understood by those skilled in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

The invention claimed is:

1. A reactive turbine apparatus, comprising:
a rotation shaft comprising a tube;
a housing rotatably coupled to the rotation shaft, the housing comprising:
an inlet formed on a first end of the housing; and an outlet formed on a second end of the housing;
a first rotation unit disposed inside the housing and axially coupled to the rotation shaft; and
a back-pressure chamber defined by the housing and the first rotation unit, wherein the back-pressure chamber, the inlet, and the tube are in fluid communication.

2. The reactive turbine apparatus of claim 1, further comprising:
a second rotation unit disposed inside the housing and axially coupled to the rotation shaft;
a sealing member interposed between a peripheral surface of the first rotation unit and an inner surface of the housing;
a second sealing member interposed between a peripheral surface of the second rotation unit and the inner surface of the housing;
wherein the inlet is formed in a middle portion of the housing, and the outlet comprises a plurality of holes.

3. The reactive turbine apparatus of one of claims 1 and 2, wherein the first rotation unit comprises
a first rotation part and a second rotation part attached to the first rotation part, and wherein:
the first rotation part comprises:
a disk shape; and
a hole oriented parallel to the rotation shaft; and
the second rotation part comprises:
a disk shape;
a passage formed at a location corresponding to the hole; and
nozzles in fluid communication with the passage and formed on a peripheral surface of the second rotation part.

4. The reactive turbine apparatus of one of claims 1 and 2, further comprising a sealing member interposed between a peripheral surface of the first rotation unit and an inner surface of the housing.

5. The reactive turbine apparatus of claim 1, wherein the first rotation unit is configured to drive the rotation shaft by ejecting fluid.

6. The reactive turbine apparatus of claim 5, wherein fluid is prevented from leaking between a peripheral surface of the first rotation unit and an inner surface of the housing during rotation of the first rotation unit, and wherein the back-pressure chamber is configured to enable fluid communication between the back-pressure chamber and an environment.

7. The reactive turbine apparatus of 2, wherein the first rotation unit and the second rotation unit each comprise a first rotation part and a second rotation part attached to the first rotation part, and wherein:
the first rotation parts each comprise:
a disk shape; and
a hole oriented parallel to the rotation shaft; and
the second rotation parts each comprise:
a disk shape;
a passage formed at a location corresponding to the hole; and
nozzles in communication with the passage and formed on a peripheral surface of each second rotation part.

8. A reactive turbine apparatus, comprising:
a rotation shaft formed of a predetermined length;
a housing defining an inner space so as to be rotatably coupled to the rotation shaft, having an inlet formed on one end thereof through which a working fluid passes, and having an outlet formed on another end thereof through which the working fluid can be discharged to an outside; and
at least one rotation unit being disposed inside the housing and coupled to the rotation shaft, being disposed in a lengthwise direction of the rotation shaft, and rotating the rotation shaft by the working fluid that enters from the inlet of the housing and then is ejected;
a back-pressure chamber defined by the housing and a rotation unit among the at least one rotation unit that is closest to the outlet; and
a communication path allowing communication between the back-pressure chamber and an environment,
wherein the working fluid is prevented from leaking between a peripheral surface of the at least one rotation unit and an inner surface of the housing during rotation of the rotation unit, and
wherein the communication path allows an inside of the back-pressure chamber and the inlet to communicate with each other through an inside of the rotation shaft.

9. A reactive turbine apparatus, comprising:
a rotation shaft;
a housing rotatably coupled to the rotation shaft, the housing comprising:
an inlet formed on a first end of the housing; and
an outlet formed on a second end of the housing;
a rotation unit disposed inside the housing and axially coupled to the rotation shaft, the rotation unit comprising a nozzle penetrating a circumferential surface of the rotation unit at a tangential angle; and
a back-pressure chamber defined by the housing and the rotation unit, wherein the nozzle comprises an inlet groove encircling an axis of the rotation unit, a conveying groove extending radially from the inlet groove, and an emitter penetrating the circumferential surface of the rotation unit at the tangential angle.

10. The reactive turbine apparatus of claim 9, wherein the emitter comprises a smaller cross sectional area than the conveying groove.

* * * * *